US005211705A

United States Patent [19]

Hagar

[11] Patent Number: 5,211,705

[45] Date of Patent: May 18, 1993

[54] APPARATUS AND METHOD FOR DELIVERY OF COMBUSTION AIR IN MULTIPLE ZONES

[75] Inventor: Donald K. Hagar, Bethlehem, Pa.

[73] Assignee: Damper Design, Inc., Allentown, Pa.

[21] Appl. No.: 607,106

[22] Filed: Oct. 31, 1990

Related U.S. Application Data

[63] Continuation of Ser. No. 508,477, Apr. 11, 1990, abandoned, which is a continuation of Ser. No. 277,206, Nov. 29, 1988, abandoned, which is a continuation of Ser. No. 28,180, Mar. 19, 1987, Pat. No. 4,801,261.

[51] Int. Cl.[5] ..... F23M 3/04

[52] U.S. Cl. ..... 431/10; 431/9; 431/182; 431/188; 431/89; 239/404; 239/406

[58] Field of Search ..... 431/9, 10, 182–184, 431/188, 89, 90; 239/404, 406

[56] References Cited

U.S. PATENT DOCUMENTS

| | | | |
|---|---|---|---|
| 2,284,708 | 6/1942 | Woolley | 431/184 |
| 2,446,069 | 7/1948 | Vroom et al. . | |
| 3,361,366 | 1/1968 | de la Fourniere | 239/406 |
| 3,649,155 | 3/1972 | Sharan | 431/89 |
| 3,695,817 | 10/1972 | Sharan | 431/182 |
| 4,326,702 | 4/1982 | Oueneau et al. | 431/182 |
| 4,504,216 | 3/1985 | Hagar et al. . | |
| 4,602,571 | 7/1986 | Chadshay | 431/182 |
| 4,681,532 | 7/1987 | Chung | 431/183 |
| 4,690,075 | 9/1987 | Vidal et al. | 431/183 |
| 4,801,261 | 1/1989 | Hagar | 431/182 |

*Primary Examiner*—Carroll B. Dority
*Attorney, Agent, or Firm*—Foley & Lardner

[57] ABSTRACT

An air register apparatus, method, and arrangement is disclosed in which each air register includes two portions, one of which feeds combustion air to an inner, ignition zone where fuel is first ignited, the other of which feeds combustion air to an outer, supplemental zone where the main combustion takes place. These two register portions provide separate and discrete air streams having measurable characteristics which accurately reflect the characteristics of the overall flow through each register portion and which characteristics govern combustion characteristics in the associated zone. Each air stream passes through an inwardly spiralling scroll passageway having a simple upstream air valve at the entrance to the passageway for controlling the flow of air through the passageway. This upstream air valve is remote from the hostile environment of the furnace or other combustion device.

2 Claims, 4 Drawing Sheets

APPARATUS AND METHOD FOR DELIVERY OF COMBUSTION AIR IN MULTIPLE ZONES

This application is a continuation of application Ser. No. 07/508,477, filed Apr. 11, 1990, now abandoned which is a continuation of application Ser. No. 07/277,206, filed Nov. 29, 1988, now abandoned, which is a continuation of Ser. No. 028,180, filed Nov. 19, 1987 now U.S. Pat. No. 4,801,261 issued Jan. 31, 1989.

BACKGROUND OF THE INVENTION

1. Field of the Invention

The present invention relates to feeding of combustion air to a combustion device. In particular, the invention relates to air registers which surround a fuel nozzle and which deliver combustion air to be mixed with the fuel fed to the combustion device by the fuel nozzle. In this way a fuel-air mix is provided to support combustion.

2. Background of the Invention

In the burning of fuels using burners fed by air registers, it has become known in the industry to divide the combustion air into an inner ignition zone and an outer, supplemental zone which concentrically surrounds the inner ignition zone. The purpose of the divided zones is to separate the high intensity mixing necessary for good ignition stability at the center of the fire from the smoother air flow at the perimeter, where it is important to avoid the nitrous oxide production of a very hot, intense flame.

The present invention is directed to enhancing and improving multiple zone combustion by providing an air register apparatus, method, and overall arrangement in which enhanced control over the characteristics of the combustion in the inner and outer zones may be achieved.

The present invention extends and improves upon certain enhanced flow characteristics, flow measurability, and flow control as provided in U.S. Pat. No. 4,504,216 to Donald K. Hagar et al, which patent is hereby incorporated herein by reference. In that patent, an air register is disclosed utilizing an inwardly spiralling scroll passageway which organizes the air flow, which air flow may be measured and which is controlled by a simple upstream valve remote from the hostile environment of the furnace. Reference is made to the aforesaid U.S. Pat. No. 4,504,216 for a more complete discussion of this subject matter.

As further background, reference is also made to Chapter 9 of "Steam/Its Generation and Use" by the Babcock and Wilcox Company, 1978 ed., which is hereby incorporated by reference, and which discusses and illustrates the use of air registers for supplying combustion air to a combustion device. Again, reference is made to this Babcock and Wilcox publication for a more complete discussion of the background, context and environment of the present invention.

SUMMARY OF THE INVENTION

It is an object of the present invention to provide an improved apparatus, method, and arrangement for delivery of combustion air to a combustion device in multiple zones.

It is another object of the present invention to provide an apparatus, method, and arrangement for controllably delivering combustion air to an inner ignition zone in the combustion device and for separately, controllably delivering combustion air to an outer supplemental zone.

It is another object of the present invention to provide an apparatus, method, and arrangement which provides a first, discrete stream of air having measurable and controllable characteristics which govern combustion characteristics in an inner ignition zone and delivering a second, separate, discrete stream of air having measurable and controllable characteristics which govern combustion characteristics in an outer, supplemental zone.

It is yet another object of the invention to provide an improved air register apparatus, method, and arrangement which delivers a larger amount of air flow and velocity at an inner ignition zone than the proportionate share of the register outlet area for that ignition zone, thereby concentrating combustion air where it is needed for ignition stability.

It is yet another object of the present invention to provide an air register apparatus, method, and arrangement in which combustion in the supplemental zone may be modulated based on an accurate measurement of air flow through a portion of the air register, which measurement of air flow represents the entire air flow through that particular register portion, to thus enhance stability of the flame produced by the air register when used with an associated fuel nozzle.

It is another object of the present invention to provide an air register apparatus, method and arrangement in which the sum of: 1) air flow through the inner ignition zone register portion and 2) air flow through the supplemental register portion can be adjusted proportionally to fuel flow for a specific burner among a set burners to optimize the combustion product by that particular burner irrespective of the condition of other burners.

It is yet another object of the present invention to provide an air register apparatus and arrangement in which vanes in the air register are capable of producing nearly the same tangential air flow velocity at the small, inner ignition zone as at the large, outer supplemental zone.

These and other objects, purposes and advantages of the present invention will be apparent from the detailed description which follows and from the drawing.

The objects of the invention are achieved by an air register for feeding combustion air to a combustion device having a register body with two register portions, one register portion being an inner zone register portion for supplying combustion air to the ignition zone of the combustion device, the other register portion being a supplemental zone register portion for supplying combustion air to the supplemental zone of the combustion device.

The ignition zone register portion has an ignition zone register inlet for combustion air, an ignition zone register outlet for combustion air, an ignition zone register scroll section, and an ignition zone register air valve. The ignition zone register air valve is disposed adjacent the ignition zone register inlet and upstream of the ignition zone register scroll section. The ignition zone register scroll section and ignition zone register air valve are in communication with each other, such that the ignition zone register air valve controls the flow of combustion air through the ignition zone register scroll section. The ignition zone register scroll section has an ignition zone register scroll passageway which spirals inwardly in the direction of combustion air flow therethrough.

The supplemental zone register portion has a supplemental zone register inlet for combustion air, a supplemental zone register outlet for combustion air, a supplemental zone register scroll section, and a supplemental zone register air valve. The supplemental zone register air valve is disposed adjacent the supplemental zone register inlet and upstream of the supplemental zone register scroll section. The supplemental zone register scroll section and the supplemental zone register air valve are in communication with each other such that the supplemental zone register air valve controls the flow of combustion air through the supplemental zone register scroll section. The supplemental zone register scroll section has a supplemental zone register scroll passageway which spirals inwardly in the direction of combustion air flow therethrough.

The ignition zone register portion and the supplemental zone register portion are so coupled to each other and so disposed with respect to each other that the ignition zone register portion controllably delivers combustion air to the air ignition zone, and the supplemental zone register portion controllably delivers combustion to the outer supplemental zone. In this way combustion in the inner ignition zone and combustion in the outer supplemental zone may be separately controlled.

In the use of the present invention, a first air stream is created which has measurable characteristics representing the characteristics of a first portion of combustion air fed to the combustion device, which first combustion air portion supports and governs combustion in the ignition zone. A second air stream is create having measurable characteristics representing characteristics of a second portion of combustion air fed to the combustion device, which second combustion air portion supports and governs combustion in the supplemental zone. That is, each discrete stream of air through a different portion of the register has its own measurable characteristics which govern combustion characteristics in its associated zone within the combustion device. This in turn facilitates separate control of the characteristics of combustion in the two zones by adjusting a simple air valve associated with the particular air stream to be adjusted, which air valve is located away from the hostile environment of the furnace upstream of an inwardly spiralling scroll passageway.

According to the present invention, one or both of the register portions include a set of spirally twisting vanes in the scroll section. The vanes are mutually so disposed as to represent a truncated cone having a small radius end and a large radius end. The vanes each have an angle of incidence relative to incoming air flow which varies with the radius of the truncated cone such that the vanes at the small radius end of the truncated cone direct flowing air to a higher angular velocity than do the vanes at the large radius end of the truncated cone. The large radius end of the truncated cone is closer to the combustion device than is the small radius end. Vanes of this type are advantageous in both of the register portions, but they are especially advantageous in the ignition zone register portion, where they effect an acceleration of the air flow in the ignition zone.

BRIEF DESCRIPTION OF THE DRAWING

FIG. 3B also shows the fuel nozzle in place in the center of the register.

DETAILED DESCRIPTION OF THE PREFERRED EMBODIMENT

Figure 1:
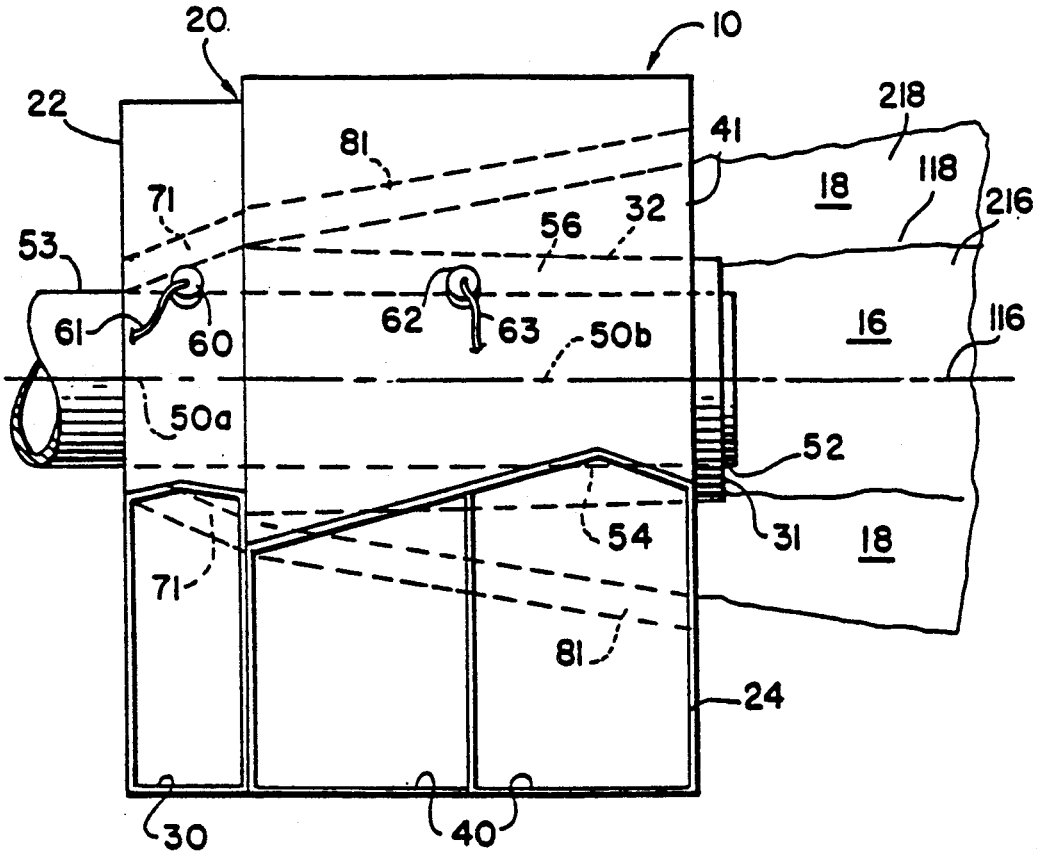
FIG. 1 is a side elevation cf a register according to the present invention in which register a fuel nozzle is installed, the overall combination of the register and fuel nozzle providing a burner for supplying a fuel-air mix to the furnace or other combustion device.

In the following description and in the drawing, like reference numerals, used among the various figures of the drawing refer to like elements or features.

Figure 2:
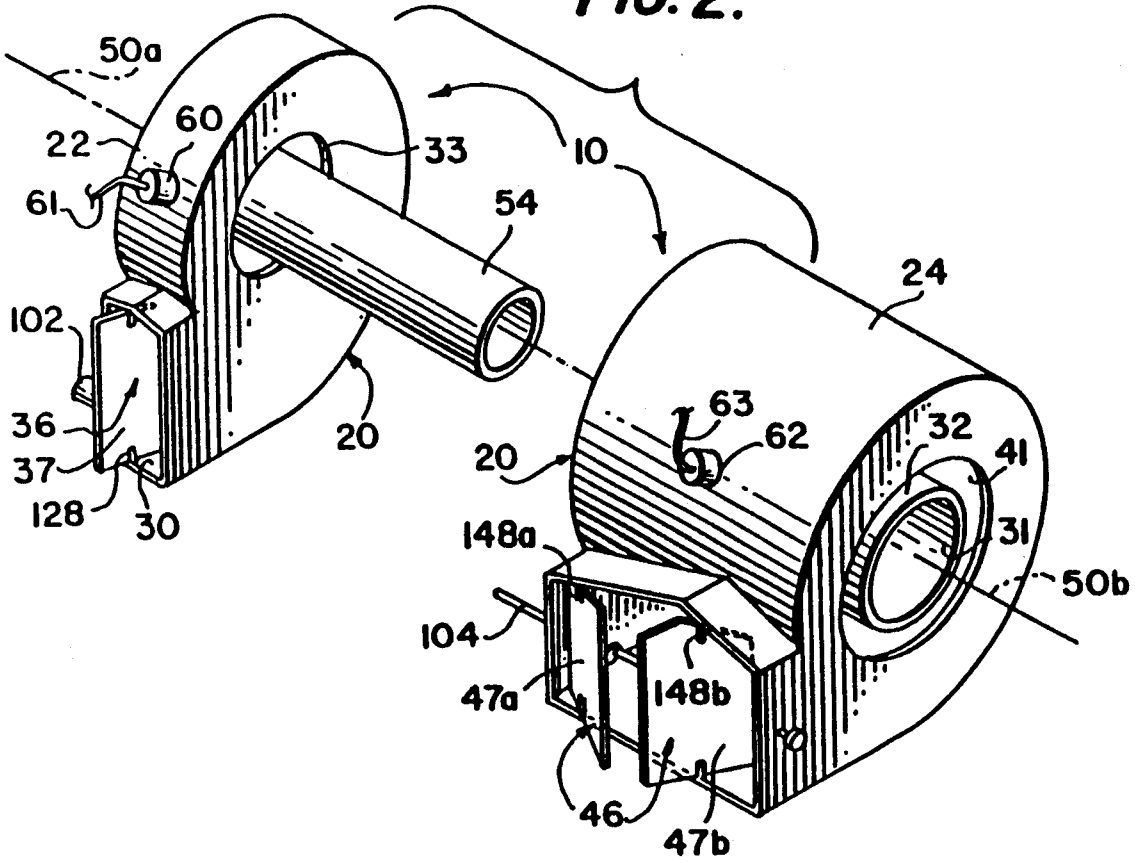
FIG. 2 is an exploded perspective view of the register of the present invention, showing two major portions of the register separated from each other.

Referring to FIGS. 1 and 2, reference numeral 10 generally refers to the air register of the present invention. Air register 10 feeds combustion air to a combustion device 12 (FIG. 7) such as a furnace which fires a boiler to produce steam for generating electricity in a power plant. Air register 10 feeds the combustion air in such a manner as to provide an inner ignition zone 16 (FIG. 1), where fuel is first ignited, and an outer, supplemental zone 18 (FIG. 1), where the main combustion in the combustion de:,ice or furnace 12 takes place.

Air register 10 includes a register body 20 having two register portions, namely, an ignition zone register portion 22 for supplying combustion air to the ignition zone 16 of the combustion device and a supplemental zone register portion 24 for supplying combustion air to the outer, supplemental zone 18 of the combustion device 12. The exploded perspective view of FIG. 2 illustrates a substantial part of the ignition zone register portion 22 at the upper left and the supplemental zone register portion 24 at the lower right.

Ignition zone register portion 22 has an ignition zone register inlet 30 for combustion air and an ignition zone register outlet 31 for combustion air. As will be seen in FIGS. 1 and 2, ignition zone register outlet 31 is disposed generally at the furnace side of supplemental zone register portion 24. That is, supplemental zone register portion 24 has extending concentrically axially through the center thereof an ignition zone register outlet barrel 32 which receives the output of ignition zone register portion 22 so as to discharge the combustion air of ignition zone register portion 22 into the furnace at the furnace side of supplemental zone register portion 24. The ignition zone register outlet barrel 32 receives combustion air from ignition zone register portion 22 via intermediate discharge opening 33 in the part of ignition zone register portion 22 included in the subassembly shown at the upper left of FIG. 2.

Ignition zone register portion 22 includes an ignition zone register scroll section 34 for directing air from ignition zone register inlet 30 to intermediate discharge opening 33, through ignition zone register outlet barrel 32 and thence to ignition zone register outlet 31. The flow of air through ignition zone register inlet 30 is controlled by a simple ignition zone register air valve 36 in the form of a butterfly valve having a simple pivotal valve member 37 which regulates the amount of air which may flow into scroll section 34 through inlet 30. Ignition zone register air valve 36 is disposed adjacent ignition zone register inlet 30 and upstream of (in terms of the direction of air flow) the ignition zone register scroll section 34.

Figure 3A:
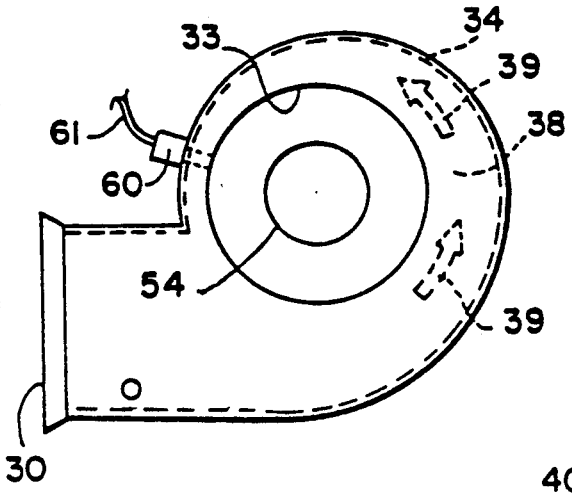
FIG. 3A is an end elevation viewed from the furnace side of the ignition zone register portion of the register of the present invention.

The ignition zone register scroll section 34 and ignition zone register air valve 36 are in communication with each other such that the ignition zone register air valve 36 controls the flow of combustion air through the ignition zone register scroll section 34. The ignition zone register scroll section 34 has an ignition zone register scroll passageway 38 (FIG. 3A) which spirals inwardly in the direction of combustion air flow therethrough. This flow of combustion air through scroll passage 38 is represented by the arrow 39 shown in phantom lines in FIG. 3A. Ignition zone register scroll passageway 38 has an ever diminishing cross sectional area in the direction of air flow 39 in a manner analogous to the ever diminishing cross sectional area of the passageway in a Nautilus shell in a direction of advance toward the interior of the shell.

The function of the scroll passageway of diminishing cross-section is to maintain a constant air flow velocity throughout the register portion. Air flowing through a register tends to lose velocity through friction loss and back-pressure. The ever-diminishing cross section of the inwardly spirally scroll section, however, offsets this tendency through a nozzle-like tendency to accelerate the flow of air through the scroll passageway. Once the air in the register portion reaches the first vane in the vane assembly disposed in the scroll section (which vane assembly will be described later,) the air flow velocity will then remain constant through the register. This, in turn, minimizes expansion and contraction of the flowing air, which in turn minimizes pressure drop and energy loss through the register. This also maintains the sane inlet conditions for each succeeding vane in the vane assembly to achieve uniformity in the flow, including uniform flow around the entire periphery of the outlet opening.

Supplemental zone register portion 24 has a supplemental zone register inlet 40 for combustion air and a supplemental zone register outlet 41 for combustion air. Supplemental zone register outlet 41 is concentrically disposed coaxially with, but radially outside of, ignition zone register outlet 31. Both ignition zone register outlet 31 and supplemental zone register outlet 41 take the form of annular openings, supplemental zone register outlet 41 representing a coaxial annular band outside of and immediately contiguous with the annual band representing the ignition zone register outlet 31. Supplemental zone register outlet 41 feeds combustion air into the combustion device 12 for supporting and controlling combustion in the outer, supplemental zone 18, whereas ignition zone register zone outlet 31 provides combustion air for supporting and controlling combustion in the inner, ignition zone 16 of combustion device 12.

Figure 3B:
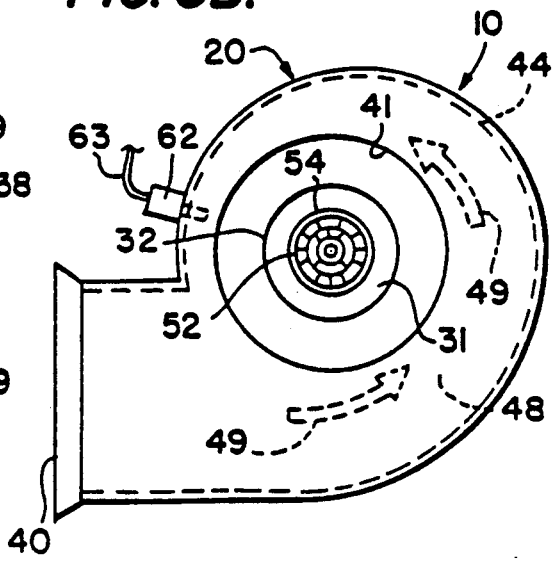
FIG. 3B is an end elevation viewed from the furnace side of the supplemental zone register portion of the register of the present invention.
Figure 4:
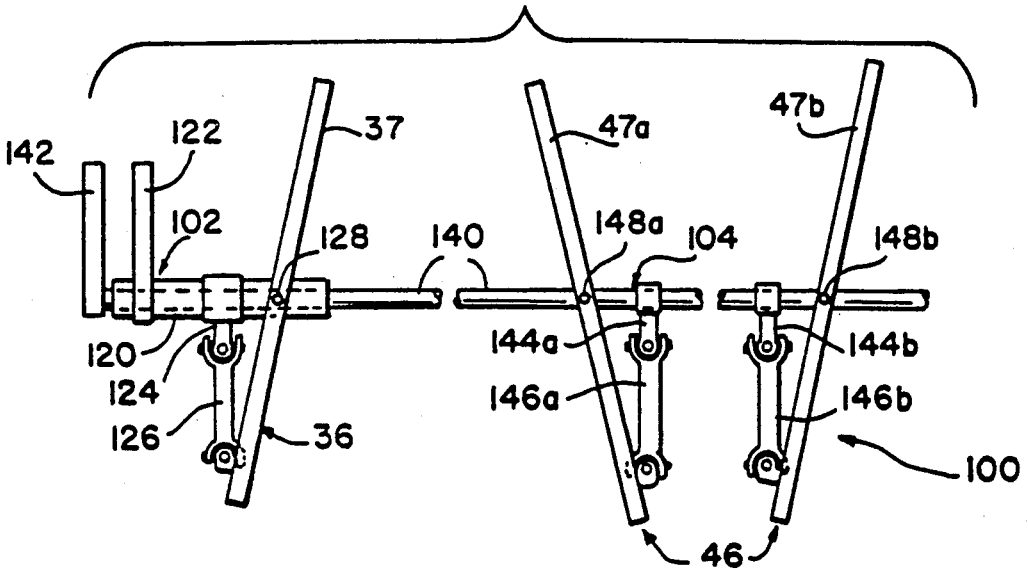
FIG. 4 is a plan view of the valve actuating mechanism for operating the air valves of the register of the present invention.

Supplemental zone register portion 24 includes a supplemental zone register scroll section 44 (FIG. 3B) into which combustion air flows under the control of a supplemental zone register air valve 46 (FIGS. 2 and 4.) Supplemental zone register air valve 46 is disposed adjacent supplemental zone register inlet 40 and upstream of (in the direction of combustion air flow) the supplemental zone register scroll section 44.

Supplemental zone register scroll section 44 and supplemental zone register air valve 46 are in communication with each such that the supplemental zone register air valve 46 controls the flow of combustion air through supplemental zone register scroll section 44. Supplemental zone register air valve 46 takes the form of a simple, opposed louver valve having a pair of pivotal valve members 47*a*, 47*b* (FIGS. 2 and 4) which swing arcuately to adjust the amount of air flowing into supplemental zone register inlet 40 and thence through supplemental zone register scroll section 44.

Supplemental zone register scroll section 44 has a supplemental zone register scroll passageway 48 which spirals inwardly in the direction of combustion air flow therethrough. Such flow of combustion air through supplemental zone register scroll passageway 48 is represented by arrow 49 shown in phantom lines in FIG. 3B. Supplemental zone register scroll passageway 48 has an ever diminishing cross section analogous to that the passageway through a Nautilus shell, as described in more detail in connection with ignition zone register scroll passageway 38.

Ignition zone register portion 22 and supplemental zone register portion 24 are so coupled to each other and so disposed with respect to each other that ignition zone register portion 22 controllably and measurably delivers combustion air in flow path 39 to the inner, ignition zone 16, and the supplemental zone register portion 24 controllably and measurably delivers combustion air in flow path 49 to the outer, supplemental zone 18. In this way, combustion in the inner, ignition zone 16 and combustion in the outer, supplemental zone 18 may be separately controlled.

Ignition zone register portion 22 has a central axis 50*a*, and supplemental zone register portion 24 has a central axis 50*b*. Each register portion 22, 24 spirals inwardly about and toward its central axis 50*a*, 50*b*. Axis 50*a* of ignition zone register portion 22 and an axis 50*b* of supplemental zone register portion 24 are coextensive with each other.

As may best be appreciated from FIG. 2, a substantial part, but preferably not the entirety, of ignition zone register portion 22 is disposed in axial series with respect to supplemental zone register portion 24. That is, a substantial part of ignition zone register portion 22 is disposed axially next to supplemental zone register portion 24 in contiguous relationship therewith. In the preferred embodiment shown and described herein, one element, which is functionally part of ignition zone register portion 22, is, however, physically part of the subassembly which comprises supplemental zone register portion 24 and which is shown at the lower right of FIG. 2. This particular element which is functionally a part of ignition zone register portion 22 is ignition zone register outlet barrel 32. When the substantial par of ignition zone register 22 shown at the upper left of FIG. 2 is coupled with supplemental zone register portion 24, intermediate discharge opening 33 will be in registry with ignition zone outlet barrel 32, such that air flow 39 through ignition zone register scroll section 44 will pass through intermediate discharge opening 33 and through ignition zone register outlet barrel 32 to be discharged into the furnace or other combustion device 12 at ignition zone register outlet 31 on the furnace side of ignition zone register outlet barrel 32.

It will thus be apparent that a part other than the aforesaid substantial part of ignition zone register portion 22 (the substantial part being represented by the subassembly shown at the upper left cf FIG. 2, the other part being represented by the ignition zone register outlet barrel which is part of the subassembly shown in the lower right of FIG. 2) is disposed radially within the supplemental zone register portion 24. This other part, i.e., ignition zone register outlet barrel 32, provides a conduit through which combustion air for supporting and controlling combustion in the ignition zone as discharged. Outlet barrel 32 preferably tapers radially inwardly along an axial path away from ignition zone register scroll section 34, i.e., in a direction toward the furnace or combustion device 12. This helps to further accelerate and concentrate air flow 39 in the ignition zone register portion 22 prior to discharge into the combustion device 12.

The result is higher air flow velocity with lower differential pressure between the inlet and outlet, as compared with known arrangements. In other words, for a given inlet to outlet differential pressure, the arrangement of the present invention provides a higher air flow velocity than known devices. Also, the present invention permits control and adjustment of the kinetic energy at the outlet with a constant inlet-to-outlet differential pressure, i.e., the kinetic energy at the outlet may be varied while the inlet-to-outlet differential pressure remains constant. As already indicated, a high kinetic energy in the ignition zone is desirable. With the arrangement of the present invention, this kinetic energy may be independently varied in relation to that of the outer, supplemental zone without changing the inlet-to-outlet differential pressure.

Figure 7:
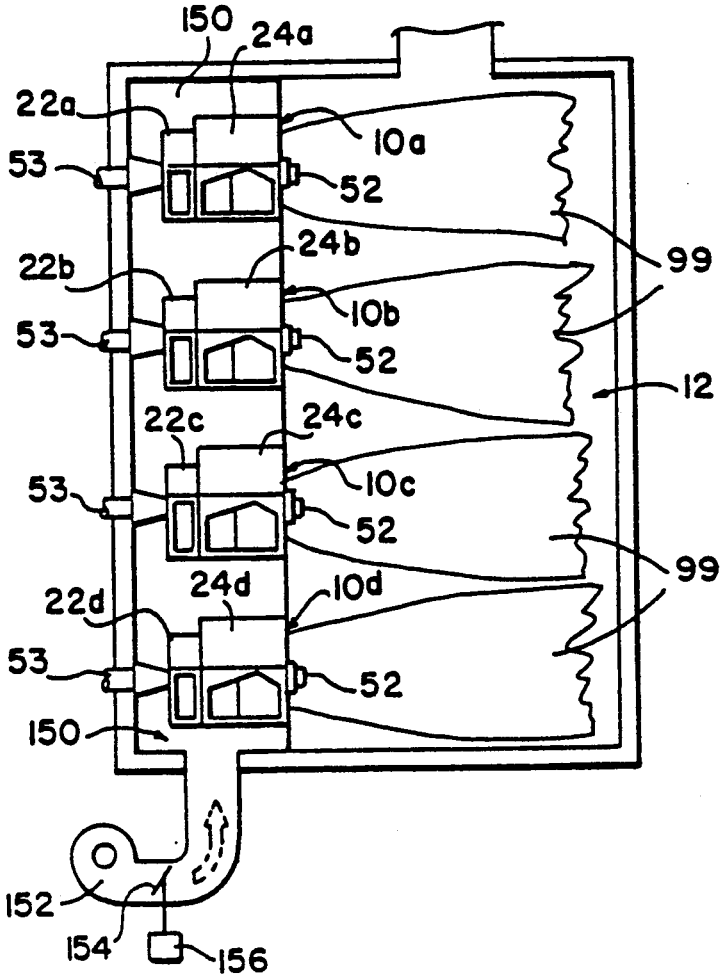
FIG. 7 is a schematic diagram showing a plurality of registers according to the present invention, along with their associated fuel nozzles (to provide burners) in a windbox.

Combustion device 12 to which combustion air is fed by air register 10 receives fuel from a fuel nozzle 52, which in turn receives fuel from a fuel supply 53 (FIGS. 1 and 7). Example of fuels which may be supplied by fuel supply 53 and injecting into combustion device 12 by fuel nozzle 52 include: pulverized coal entrained in pressurized air (known as "primary" air which is different from "secondary" air, referred to herein as "combustion air"); oil; and natural gas.

Body 20 of air register 10 includes a mounting tube 54 for mounting fuel nozzle 52 with respect to body 20 so that ignition zone register outlet barrel 32 coaxially surrounds fuel nozzle 52 in mounting tube 54 to create an ignition zone register outlet passage 56 between ignition zone register outlet barrel 32 and fuel nozzle 52 or, more precisely, mounting tube 54 in which fuel nozzle 52 is disposed Because outlet barrel 32 tapers radially inwardly toward combustion device 12, outlet passage 56 takes the form of an ever diminishing annular space in a direction toward combustion device 12. That is, ignition zone register outlet passage 56 has an ever diminishing cross section in a direction toward the ignition zone register outlet.

The ignition zone register scroll passageway 38 and the supplemental zone register scroll passageway 48 are isolated from communication with each other during the flow of combustion air from the inlet to the outlet of each register portion 22, 24. That is, air flow 39 in ignition zone register portion 22 is isolated from air flow 49 in supplemental zone register 24. This facilitates separate and independent control over combustion at the ignition zone and combustion at the outer, supplemental zone in combustion device 12. This independent control is effected in the ignition zone 16 by ignition zone register air valve 36 and in the supplemental zone 24 by supplemental zone register air valve 46.

Also contributing to separate control of the ignition zone register air flow 39 and supplemental zone register air flow 49 is a flow measuring instrument 60 in the ignition zone register scroll section 34 which sends through line 61 an output signal representative of characteristics of the air flow 39 in ignition zone register scroll section 34 and a flow measuring instrument 62 in supplemental zone register scroll section 44 which sends a signal through line 63 representative of characteristics of the air flow 49 in supplemental zone register scroll section 44.

The inwardly spiralling scroll passageway 38 of ignition zone register portion 22 organizes air flow 39 such that insertion of a measuring instrument into an appropriate part of ignition zone register scroll passageway 38 results in a measurement which is representative of the total air flow through the ignition zone register scroll passageway 38. This is entirely unlike conventional air registers in which air is admitted around the circumference of the air register. The result in conventional air registers is that no discrete air flow passageway or air flow path is provided which represents overall air flow to thereby frustrate any attempt to measure characteristics of the flow and, based on such measurements, to control air flow through the air register and in turn control combustion.

These same desirable characteristics for the ignition zone register portion 22 hold true as well for the supplemental zone register portion 24. That is, with the device of the present invention, measurements representative of the entire air flow through the supplemental zone register portion 24 may be taken in a very simple manner via instrument 62 as a result of the organization of flow 49 into a single, inwardly spiralling path through a passageway 48 of ever diminishing cross section. The measurements taken with respect to air flow 49 then become the basis for controlling that flow in a manner such that the control is based on an accurate representation of the entirety of the flow through the supplemental zone register portion 24.

What is more, not only may the flows 39, 49 through register portions 22, 24 be accurately measured and controlled, but also these flows may be accurately measured and controlled separately and independently of one another. That is, combustion air flow 39 which supports combustion in the inner ignition zone 16 may be independently adjusted to provide high intensity mixing in ignition zone 16 so as to provide good ignition stability at the center of the flame. By the same token, air flow 49 for supporting combustion in the outer supplemental zone 18 may be independently adjusted to provide a smoother air flow around the perimeter to avoid the nitrous oxide production typical of a very hot, intense flame.

The arrangement according to the present invention provides for minimum shear between the ignition zone and supplemental zone at full load firing, where nitrous oxides from high combustion intensity have been the greatest problem in known devices. The shear between zones results from the different flow characteristics of the two zones in known devices. The flow in the ignition zone is rapid, intense and swirling, while the flow in the supplemental zone is less intense, slower, has a relatively low degree of swirl and is generally axial in known devices. The interface between these two types of flows in known arrangements creates the aforementioned shear, which in turn creates an undesirably high combustion intensity at full load. The arrangement of the present invention produces minimum shear between the ignition zone and supplemental zone to minimize undesirable combustion intensity and nitrous oxide production at full load. While the arrangement of the present invention causes a higher flow velocity in the ignition zone than in the supplemental zone, as do prior art arrangements, the present invention provides for the combustion air to emerge into the respective zones 16, 18 in parallel, i.e., at helixes that nearly match one another, to reduce shear between zones 16, 18.

Zones 16, 18 include innermost and outermost regions. That is ignition zone 16 includes an innermost region 116 and an outermost region 216. Similarly, supplemental zone 18 includes an innermost region 118 and an outermost region 218.

Figure 5:
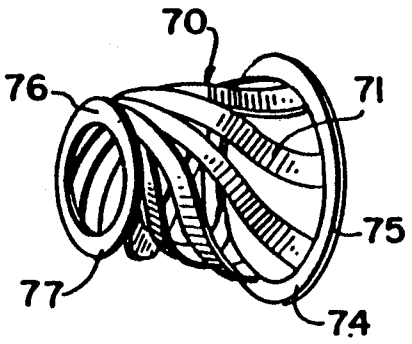
FIG. 5 is a perspective view showing an ignition zone register vane assembly used in the register of the present invention.
Figure 5A:
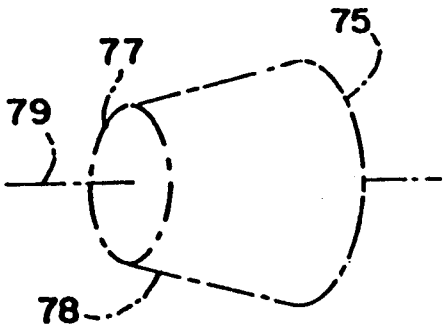
FIG. 5A shows the truncated conical shape of the assembly of FIG. 5, and FIGS. 5B and 5C are fragmentary, detail, sectional views showing certain parts of the vanes of the vane assembly of FIG. 5.

Disposed within ignition zone register scroll section 34 is an ignition zone register vane assembly 70 (FIG. 5) which includes a set of spirally twisting, ignition zone register vanes 71. Toward the furnace side of ignition zone register portion 22, vanes 71 terminate in and are mounted in a large radius mounting ring 74 representing a large radius end 75 of vane assembly 70. At an end most remote from the furnace, vanes 71 terminate in and are mounted in a small radius mounting ring 76 representing a small radius end 77 of vane assembly 70. Vanes 71 and rings 74, 76 are mutually so disposed as to represent a truncated cone 78 (FIG. 5A,) which truncated cone has an axis 79 which is coaxial and coextensive with central axis 50*a* of the ignition zone register portion 22.

Figure 6:
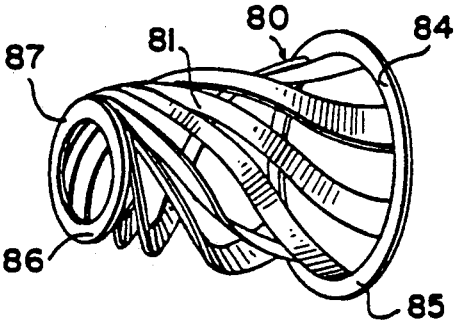
FIG. 6 is a perspective view showing a supplemental zone register assembly used in the register of the present invention.
Figure 6A:
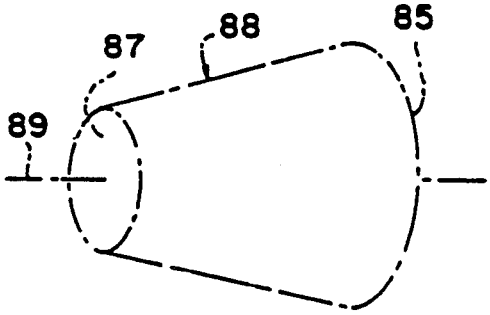
FIG. 6A shows the truncated conical shape of the assembly of FIG. 6, and FIGS. 6B and 6C are fragmentary, detail, sectional views showing certain parts of the vanes of the vane assembly of FIG. 6.

Disposed within the supplemental zone register scroll section 44, is a supplemental zone register vane assembly 80 (FIG. 6.) Supplemental zone register assembly 80 includes a set of spirally twisting supplemental zone register vanes 81 which terminate at and are mounted in a large radius mounting ring 84 disposed on the furnace side of supplemental zone register portion 24. Mounting ring 84 represents a large radius end 85 of supplemental zone register vane assembly 80. Opposite large radius mounting ring 84 is a small radius mounting ring 86 remote from the furnace side o supplemental zone register portion 24. Small radius mounting ring 86 represents a small radius end of the supplemental zone register vane assembly 80. Supplemental zone register vanes 81 and mounting rings 84, 86 are mutually so disposed as to represent a truncated cone 88 (FIG. 5A) which truncated cone 88 has an axis 89 which is coaxial with and coextensive with central axis 50*b* of supplemental zone register portion 24.

It is to be understood that many of the fundamental advantages of the present invention are independent of the use of spirally twisting vanes 71, 81. That is, many of the advantages of the present invention would still remain even if vanes such as those disclosed in U.S. Pat. No. 4,504,216 were used in the present context, which vanes will be referred to as axial vanes. Use of axial vanes in lieu of spirally twisting vanes would reduce initial capital expenditures for users of registers according to the present invention.

Nevertheless, the most desireable arrangement irrespective of initial capital cost, is the use of spirally twisting vanes in both the ignition zone register portion 22 and supplemental zone register portion 24. The next most desireable arrangement, and a good compromise between optimum performance and initial capital cost, is the use of spirally twisting vanes 71 for the ignition zone register portion 22 and axial vanes for the supplemental register portion 24.

Figure 5B:
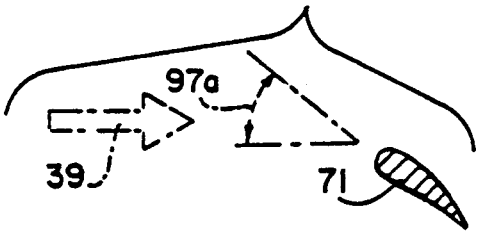
Figure 5C:
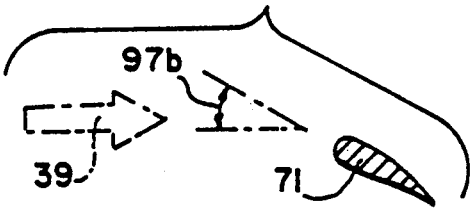

In use, spirally twisting vane assemblies 70, 80 help direct air flows 39, 49 in optimum, swirling paths as these air flows approach the outlets 31, 41 of their respective register portions 22, 24. In particular, the ignition zone register vanes 71 have angles of incidence 97*a*, 97*b* (FIGS. 5B and 5C) relative to incoming air flow 39 which varies with the radius of the truncated cone 78, such that the ignition zone register vanes 71 at the small radius end 77 of the truncated cone 78 are at an angle of incidence 97*a* (FIG. 5B) to direct flowing a higher angular velocity than do the same ignition zone register vanes 71 when they are disposed at the large radius end 75 of the truncated cone, which vanes 71 at the large radius end are disposed at the angle of incidence 97*b* (FIG. 5C).

Figure 6B:
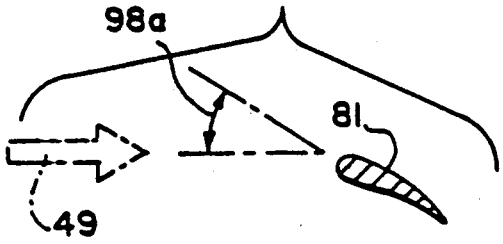
Figure 6C:
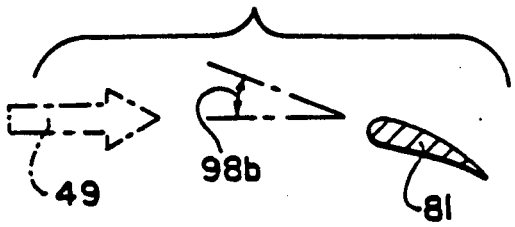

Similarly, supplemental zone register vanes 81 have angles of incidence 98*a*, 98*b* (FIGS. 6B and 6C) relative to incoming air flow 49 which vary with the radius of the truncated cone 88 such that the supplemental zone register vanes 81 at the small radius end 87 of truncated cone 88 are at an angle of incidence 98*a* to direct flowing air 49 to a higher angular velocity than do the same supplemental zone register vanes 81 at the large radius end 85 of the truncated cone 88, which vanes 81 at the large radius end are disposed at an angle of incidence 98*b* (FIG. 6C) relative to the air flow 49. Preferably, angles of incidence 98*a* and 97*b* are the same to minimize turbulence at the boundary between ignition zone register outlet 31 and supplemental zone register outlet 41.

With this arrangement of vanes, nearly the same tangential air flow velocity is produced in the radially innermost region 116 ignition zone 16 as in the radially outermost region 218 of supplemental zone 18 when the ignition zone air valve and supplemental zone air valve are both fully open. This, in turn, results in an improved fuel-air mix at the core of the fire 99 (FIG. 7) produced by each combined air register and fuel nozzle (i.e., by each burner.)

As a result of centripetal acceleration of air flow, to which the spirally twisting vanes make a substantial contribution, air flow velocity is higher at the outermost region 216 of the ignition zone 16 than at the innermost region 118 of the supplemental zone 18. Air flow velocity diminishes in the ignition zone from the inside out, i.e., from the innermost region 116 to the outermost region 216, when spirally twisting vanes are used. The result is that, as already indicated, the tangential velocity of air flow is approximately the same at the innermost region 116 of the ignition zone 16 as at the outermost region 218 to the supplemental zone 18.

The significance of this is that more combustion occurs toward inner part of the fire 99 than would otherwise be possible, i.e., less of the fuel has to migrate to the outside of fire to mix with air for ignition. The effect is a tighter, more contained fire 99 with improved combustion characteristics, particularly in terms of lower production of oxides of nitrogen.

The high centripetal acceleration produced in the ignition zone 16 when spirally twisting vanes are used in the ignition zone register portion 22 results in capture of the fuel by the accelerating air in that zone. The result is that the mixing energy at the center of the fire, i.e., at the innermost region 116 of ignition zone 16 (where the mixing energy is normally low in conventional burners) is approximately the same as at the outside of the fire, i.e., at the outermost region 218 of the supplemental zone 18 (where the mixing energy is normally relatively high in conventional burners). That is, and as already indicated, in a burner using a register according to the present invention, the fuel does not have to travel to the outside of the fire to mix with sufficient air to ignite.

When fuel must migrate to the outside of the fire to ignite, the advantages of staged combustion, i.e., the advantages of combustion in multiple zones, is lost. The present invention takes full advantage of staged combustion b supplying high velocity air for mixing with fuel at the innermost region 116 of ignition zone 16 to approximately the same extent at any given point in that region as at the outermost region 218 of the supplemental zone 18.

By intensifying the mixing cf fuel and air at the center of the fire, the present invention provides conditions by which the fuel is ignited with a substantial deficiency of oxygen. Thus, in turn, suppresses the peak flame temperature in the supplemental zone and therefore reduces the ability of the burner to form oxides of nitrogen.

Others have sought to achieve similar results by withholding air at the burner and then adding air later at a different place. With the present invention, however, this is unnecessary. With the present invention, the fuel is held in tighter in the supplemental zone, and particularly the outermost region 218 thereof, than in conventional arrangements. This results in a longer elapsed time before final combustion, which in turn makes for a burner with low nitrous oxide production.

The mechanism for operating air valves 36, 46 will now be described. An overall valve actuating mechanism for air valves 36, 46 is designated generally by reference numeral 100 and illustrated in FIG. 4. Mechanism 100 includes an ignition zone register actuating portion generally designated by reference numeral 102 and a supplemental zone register actuating portion generally designated by reference numeral 104.

Ignition zone register actuating portion 102 includes a hollow rotatable shaft 102 to which is affixed an actuation arm 122. Movement of actuator arm 122 either via an automatic control system or through a human operator in response to measured conditions (such as provided by flow measuring instrument 60) results in rotation of shaft 120 which is suitably journaled in register body 20. Rotation of shaft 120, in turn, results in swinging of crank arm 124 to move connecting rod 126. This, in turn, causes valve member 37 of ignition zone register air valve 36 to pivot about its journal 128 to adjust the opening of ignition zone register air valve 36.

Supplemental zone register actuating portion 104 includes a rotatable shaft 140 (FIG. 4) which is journaled within hollow rotatable shaft 120 and concentric therewith. Actuation arm 142 is affixed to shaft 140 so that movement of actuation arm 142 in response to a condition such as measured by instrument 62 will result in rotation of shaft 140 to swing crank arms 144*a*, 144*b*. The swinging of crank are 144*a* results in movement of connecting rod 146 to in turn swing valve member 47*a* about its journal 148*a*. Simultaneously, swinging of crank arm 144*b* results in movement of connecting arm 146*b* to swing valve member 47*b* about its journal 148*b*. This swinging movement of valve members 47*a*, 47*b* adjusts the opening of supplemental zone register air valve 46 to control the air flow 49 through supplemental zone register portion 24 and specifically through the supplemental zone register scroll passageway 38 thereof.

As is customary, and according to one embodiment of the invention, more than one air register 10 according to the present invention will fire a single furnace 12 or other combustion device 12, and this is illustrated schematically in FIG. 7. As shown there, multiple registers according to the present invention, which registers are designated 10*a*, 10*b*, 10*c* and 10*d* are disposed in a single windbox 150. Windbox 150 acts as a plenum chamber to supply air to all of the air registers 10*a*, 10*b*, 10*c*, 10*d*. The registers have ignition zone register portions 22*a*, 22*b*, 22*c*, 22*d* and supplemental zone register portions 24*a*, 24*b*, 24*c*, 24*d* corresponding to those previously described.

Windbox 150 receives a stream of air 151 produced by a forced draft fan 152 and regulated by a regulating damper 154 operating by a control 156. While, according to this one embodiment of the invention, multiple registers are used in a single windbox, particularly where the invention is to be used in conventional power plants for generating electricity with fossil fuels, other embodiments of the invention may involve other contexts which do not include windboxes or multiple registers in a windbox.

By the arrangement of the present invention, air flow is improved by using an ignition zone register portion in addition to the supplemental zone register portion 24. As indicated, the ignition zone register portion 22 feeds a tapered outlet barrel 32 and it produces a higher velocity output of combustion air than would otherwise be available. Specifically, in a prototype, 25% of the total air flow through the overall register 20 was produced through 20% of the overall outlet area without any increase in pressure drop across the register. While existing burner achieve higher velocity by using a larger than proportionate share of area at the exit, the present invention concentrates air where it is needed in the inner ignition zone for ignition stability.

Whereas existing schemes also control the amount of combustion air by regulating the flow of air produced by the forced draft fan 152 which feeds the windbox, the present invention entails regulating the windbox-to-furnace differential pressure not only by the forced draft fan but also by controlling the air flow by modulating the supplemental zone of the active registers. Utilizing this scheme, the present invention maintains a constant ignition zone flow volume and kinetic energy. This enhances the stability of the flame at low firing range and creates an opportunity for elimination of the use of an additional fuel (such as the use of oil or gas in a combustion device for burning pulverized coal) to stabilize the flame, which additional fuel is an expensive necessity with present register designs.

In use the present invention supplies combustion air to a combustion device 12 by feeding air from a common source or common supply, which in the particular embodiment shown and described involves windbox 150 with its forced draft far 152. At each air register 10, the air fed from the cotton supply is divided into at least two discrete flow paths 39, 49 to produce at least two flows, each of which is susceptible of accurate flow measurement, one flow being measured by instrument 60, the other by instrument 62. These flows are indeed actually measured, a balance between the flows is selected, and the flows are regulated to maintain the selected balance. Flows are then discharged into the combustion device 12 such that one discharged flow, i.e., that of ignition zone 16, is concentrically surrounded by the other flow, i.e., that of supplemental zone 18.

According to the present invention, the two flows are handled and directed such that one of the flows, i.e., flow 39 through the ignition zone register portion 22, produces a predictably higher kinetic energy of combustion air in the combustion device 12 at the inner ignition zone 16 than does the other flow into its associated zone, i.e., flow 49 into the outer supplemental zone 18, when the flows are discharged into the combustion device. Thus, the flow 39, which produces the predictably higher kinetic energy of combustion air in the ignition zone 16 of the combustion device, is the flow which is concentrically surrounded by the other flow, i.e., the flow 49, when the flows have been discharged into the combustion device.

In operation, the use of the air register according to the present invention entails directing a first discrete stream of air, i.e., that of flow path 39, through inwardly spiraling ignition zone register scroll passageway 38, such that the air flow or air stream 39 has measurable characteristics which govern combustion characteristics in ignition zone 16. This air stream 39 is discharged into combustion device 12 after it has passed through ignition zone register scroll passageway 38, such that the discharged air stream 39 supports and governs combustion in ignition zone 16.

A second discrete air flow or air stream 49 is directed through inwardly spiraling supplemental zone register scroll passageway 48, such that the air stream 49 has measurable and controllable characteristics which govern combustion characteristics in the supplemental zone 18. Air stream 49 is discharged into the combustion device 12 after it has passed through the supplemental zone register scroll passageway 48, such that the discharged air stream 49 supports and governs combustion in the supplemental zone.

Characteristics of the combustion in the ignition zone 16 are controlled by adjusting ignition Zone register air valve 36 disposed upstream of the ignition zone register scroll passageway 38. Characteristics of the first air stream 39 are measured by measuring instrument 60 in the ignition zone register scroll passageway 38, and the aforementioned control of the combustion in the ignition zone is executed in response to the measurement of the air flow in the air stream 39.

Similarly, characteristics of combustion in the supplemental zone 18 are controlled by adjusting supplemental zone register air valve 46 disposed upstream of the supplemental zone register scroll passageway 48. Characteristics of the air stream 49 are measured with measuring instrument 62 in supplemental zone register scroll passageway 46. The aforementioned control of the characteristics of combustion in the supplemental zone is executed in response to this measurement of the air flow in the air stream 49.

While the present invention has been illustrated and described by way of a specific, preferred, exemplary embodiment, it will be understood that many additional embodiments, variations and modifications utilizing in the present invention are possible within the spirit and scope of the appended claims.

What is claimed is:

1. A method of supplying air to a combustion device comprising the steps of:

a) feeding air from a common supply to an air register;

b) dividing the air fed from the common supply at the air register into at least two discrete flow paths to produce at least two flows, each of which is susceptible of acurate flow measurement;

c) measuring the actual flow in each flow path to obtain the overall air flow, and based on said measured air flow characteristic, controlling said air flow through the air register to control combustion in the combustion device;

d) independently regulating the first flow such that the first flow produces a higher kinetic energy of combustion air in the combustion device than the second flow, to provide high intensity mixing of said first air flow and a fuel so as to provide for good ignition production at a full load when said first and second flows are discharged into the combustion device, e) independently regulating the second flow path to provide a smoother air flow near a perimeter of said air register to avoid nitrous oxide production by a very hot intense flame in said combustion device;

f) discharging said first and second air flows into the combustion device such that the first flow which produces the higher kinetic energy of combustion air in the combustion device is concentrically surrounded by the second flow, and;

g) supplying fuel to the combustion device coaxially of the air discharged into the combustion device.

2. An air register for feeding combustion air to a combustion device so as to divide the air into at least two discrete flow paths to provide at least two flows each of which is susceptible of accurate flow measurement, the air register comprising:

a) a register body;

b) means for creating a first air flow path having measurable characteristics representing the characteristics of a first portion of combustion air fed to the combustion device;

c) means for creating a second air flow path having measurable characteristics representing the characteristics of a second portion of combustion air flow to the combustion device;

d) means for both measuring the actual flow in each flow path to obtain the overall air flow in each path, and based on said air flow measurements, controlling said air flow through the air register to control combustion in the combustion device;

e) means for independently regulating the flow of air in the first flow path and adding fuel thereto such that the first flow produces a higher kinetic energy of combustion air in the combustion device than the second flow to provide high intensity mixing of the first air flow and a fuel, so as to provide for good ignition production at full load when the flows are discharged into the combustion device, f) means for independently regulating the flow of air in the second flow path to provide a smoother air flow near a perimeter of said air register to minimize nitrous oxide production of a very intense flame of said combustion device, and;

g) means for discharging said first and second air flows into the combustion device such that the first flow which produces the higher kinetic energy of combustion air in the combustion device is concentrically surrounded by the second flow.

* * * * *